US011649676B2

(12) United States Patent
Gendig et al.

(10) Patent No.: US 11,649,676 B2
(45) Date of Patent: May 16, 2023

(54) PASSAGE BARRIER AND METHOD FOR PRODUCING A PASSAGE BARRIER

(71) Applicant: DORMAKABA DEUTSCHLAND GMBH, Ennepetal (DE)

(72) Inventors: Oliver Gendig, Gevelsberg (DE); Martin Kuttruff, Sasbach (DE); Jan Meulenbeld, Breckerfeld (DE); Harald Eichner, Schwanau-Ottenheim (DE)

(73) Assignee: DORMAKABA DEUTSCHLAND GMBH, Ennepetal (DE)

( * ) Notice: Subject to any disclaimer, the term of this patent is extended or adjusted under 35 U.S.C. 154(b) by 8 days.

(21) Appl. No.: 17/284,649

(22) PCT Filed: Oct. 11, 2019

(86) PCT No.: PCT/EP2019/077640
§ 371 (c)(1),
(2) Date: Apr. 12, 2021

(87) PCT Pub. No.: WO2020/078857
PCT Pub. Date: Apr. 23, 2020

(65) Prior Publication Data

US 2021/0396060 A1 Dec. 23, 2021

(30) Foreign Application Priority Data

Oct. 15, 2018 (DE) ..... 10 2018 125 462.8

(51) Int. Cl.
*E06B 11/08* (2006.01)
*E05F 15/53* (2015.01)
*E05F 15/614* (2015.01)

(52) U.S. Cl.
CPC ..... *E06B 11/08* (2013.01); *E05F 15/53* (2015.01); *E05F 15/614* (2015.01);
(Continued)

(58) Field of Classification Search
CPC ..... E06B 11/085; E06B 11/08; E05F 15/611; E05F 15/614
(Continued)

(56) References Cited

U.S. PATENT DOCUMENTS 4,472,908 A * 9/1984 Wanzl ..... E05F 15/614 49/141
2011/0193041 A1 8/2011 Stull
(Continued)

FOREIGN PATENT DOCUMENTS

DE 102008025757 A1 10/2009
EP 1 503 020 * 2/2005
(Continued)

OTHER PUBLICATIONS

International Search Report dated Dec. 3, 2019 re: Application No. PCT/EP2019/077640, pp. 1-2.

*Primary Examiner* — Gregory J Strimbu
(74) *Attorney, Agent, or Firm* — Cantor Colburn LLP

(57) ABSTRACT

A passage barrier includes two guide elements that cooperate such that they define a gate region, through which a person passes from an entrance region into a passage region. The passage barrier has a drive with a drive unit and an output unit. The drive unit, output unit, and a barrier element are operatively connected such that the barrier element is movable via the drive unit into a position closing and a position opening the gate region. The output unit has a hollow shaft with outer and inner shell surfaces. The inner shell surface and drive unit are configured such that the inner shell surface surrounds the drive unit and the hollow shaft has a mount for fixing the barrier element on the hollow shaft. The mount is arranged on the outer shell surface and formed integrally with the hollow shaft.

8 Claims, 14 Drawing Sheets

(52) U.S. Cl.
CPC ..... *E05Y 2201/43* (2013.01); *E05Y 2201/448* (2013.01); *E05Y 2201/71* (2013.01); *E05Y 2900/40* (2013.01)

(58) Field of Classification Search
USPC ..... 49/334
See application file for complete search history.

(56) References Cited

U.S. PATENT DOCUMENTS

| | | | | |
|---|---|---|---|---|
| 2012/0233925 | A1* | 9/2012 | Linnenkohl | E05F 15/603 49/324 |
| 2013/0205670 | A1* | 8/2013 | Springborn | E05F 15/611 49/358 |
| 2014/0309041 | A1* | 10/2014 | Muller | F16D 43/2024 464/39 |
| 2015/0027058 | A1* | 1/2015 | Linnenkohl | E05F 15/614 49/31 |
| 2020/0226864 | A1* | 7/2020 | Oh | E06B 11/085 |

FOREIGN PATENT DOCUMENTS

| | | | |
|---|---|---|---|
| EP | 2690247 | A2 | 1/2014 |
| ES | 2 267 351 | * | 3/2007 |
| FR | 2789467 | A1 | 8/2000 |
| FR | 2 945 073 | * | 11/2010 |

* cited by examiner

PASSAGE BARRIER AND METHOD FOR PRODUCING A PASSAGE BARRIER

TECHNICAL FIELD

The present disclosure relates to a passage barrier and a method for manufacturing a passage barrier.

BACKGROUND

Passage barriers are usually used at locations, where the passage of people into a separated region or from a separated region needs to be regulated. Said regulation can be aimed at separating a flow of people and/or at verifying an access authorization of a person into or from a separated region. Passage barriers of this type are for example previously known from the German patent application DE102008025757A1 and are used for example in the entrance region of public buildings, in stadiums or even at events halls.

A generic passage barrier usually comprises guide elements, which define a gate region, through which people pass from an entrance region into a passage region. Inside the gate region, at least one barrier element is generally arranged that can prevent and/or enable the passage of a person from the entrance region into the passage region within the gate region. The barrier element is usually moved via a drive.

SUMMARY

The present disclosure provides a passage barrier which comprises a cost-effective and easy-to-manufacture and low-noise drive. The present disclosure also provides a method for manufacturing a passage barrier which allows the manufacture of a cost-effective and easy-to-manufacture and low-noise passage barrier.

These advantages are achieved on the one hand by providing a passage barrier according to the claims, with the passage barrier having guide elements, with the guide elements comprising a first guide element and the guide elements comprising a second guide element, with the first guide element and the second guide element cooperating in such manner that they define a gate region, through which a person passes from an entrance region into a passage region, the passage barrier comprises at least one barrier element, with the barrier element being arranged inside the gate region, with the barrier element, the first guide element and the second guide element cooperating in such manner that a passage of a person from the entrance region into the passage region can be prevented and/or enabled, the passage barrier has a drive, with the drive having a drive unit and with the drive having an output unit, with the drive unit, the output unit and the barrier element being operatively connected in such manner that the barrier element is movable by means of the drive unit into a position closing the gate region and into a position releasing the gate region, with the output unit comprising a hollow shaft, with the hollow shaft having an outer shell surface and the hollow shaft having an inner shell surface, with the inner shell surface and the drive unit being configured in such manner that the inner shell surface surrounds the drive unit at least in sections, preferably completely and the hollow shaft has a barrier element mount, with the barrier element mount being formed for fixing a barrier element on the hollow shaft, the barrier element mount being arranged on the outer shell surface of the hollow shaft and the barrier element mount being formed integrally with the hollow shaft.

A method is provided for manufacturing a passage barrier according to the claims, with the passage barrier having guide elements, with the guide elements comprising a first guide element and the guide elements comprising a second guide element, with the first guide element and the second guide element cooperating in such manner that they define a gate region, through which a person passes from an entrance region into a passage region, the passage barrier comprises at least one barrier element, with the barrier element being arranged inside the gate region, with the barrier element, the first guide element and the second guide element cooperating in such manner that a passage of a person from the entrance region into the passage region can be prevented and/or enabled, the passage barrier has a drive, with the drive having a drive unit and with the drive having an output unit, with the drive unit, the output unit and the barrier element being operatively connected in such manner that the barrier element is movable by means of the drive unit into a position closing the gate region and into a position releasing the gate region, with the output unit comprising a hollow shaft, with the hollow shaft having an outer shell surface and the hollow shaft having an inner shell surface, with the inner shell surface and the drive unit being configured in such manner that the inner shell surface surrounds the drive unit at least in sections, preferably completely and the hollow shaft having a barrier element mount, with the barrier element mount being formed for fixing a barrier element on the hollow shaft, with the barrier element mount being arranged on the outer shell surface of the hollow shaft and the barrier element mount being formed integrally with the hollow shaft, comprising the following steps in any order: at least in sections inserting the drive unit into the hollow shaft, fixing a barrier element on or in the barrier element mount of the hollow shaft, arranging the drive in or on a guide element.

Using the passage barrier according to the disclosure, a cost-effective and easy-to-manufacture drive is provided. This also allows a particularly low-noise operation since the drive is enclosed through its arrangement in a rotating hollow shaft. By integrating the barrier element mount in or on the hollow shaft, a particularly easy-to-manufacture arrangement is possible. Lastly, another advantage is the hollow shaft can be very easily adapted to any required lengths in regard to the barrier element mount.

A passage barrier can be composed of a plurality of technical components, which are described in more detail below.

In particular, a passage barrier can comprise components selected from the group of drives, drive units, output units, force transmission elements, locking apparatuses, barrier elements, guide elements, controllers and/or sensors.

The term "wall" in the sense of the application designates an object that is stationary with respect to the barrier element.

The drive comprises at least one drive unit. The drive unit can comprise at least one electric and/or hydraulic drive unit, an output and a controller.

The drive can also comprise other components, such as for example one or a plurality of electrical, electronic and/or mechanical components required to operate a passage barrier, in particular selected from the group of gears, controllers, safety apparatuses, monitoring apparatuses, monitoring systems, pulse sensors, locking apparatuses, power supply, housing, energy storage devices, force transmission elements.

The drive can preferably be arranged on and/or in a guide element of the passage barrier, on a building wall, on and/or in the building floor.

The drive can in particular be an electromechanical and/or electrohydraulic and/or pneumatic drive, wherein the barrier element can thus be closed and/or opened by means of electromechanically, electrohydraulically and/or pneumatically generated auxiliary force. The auxiliary force can in this way be designed in such manner that the auxiliary force acts in a supporting manner, i.e. that the user must apply their own reduced force when opening and/or closing the barrier element. The auxiliary force can also be designed in such manner that the barrier element is opened automatically by the auxiliary force, i.e. that the user does not have to apply their own force in addition to the auxiliary force.

The drive can in particular comprise a drive unit, by means of which electric and/or hydraulic and/or pneumatic energy can be converted into mechanical energy. To move the barrier element, a drive unit can thus receive electric and/or hydraulic and/or pneumatic energy and convert the electric and/or hydraulic and/or pneumatic energy into mechanical energy. The mechanical energy is transmitted from the drive unit to an output unit, which in turn converts the mechanical energy into movement energy of a barrier element, whereby a barrier element is movable in the direction of its opening or closing position.

The door drive can comprise one or a plurality of drive units selected from the group of the electric drive units, hydraulic drive units and/or pneumatic drive units.

To increase the operational safety, provision can be made for the drive to be designed redundantly by at least two drive units being provided such that in the event of failure of one drive unit, at least one other drive unit is available at least to support the opening and/or closing of a barrier element.

Individual groups of or all electrical, electronic and/or mechanical components can form a physical assembly with the drive unit.

A drive unit can convert electric, hydraulic and/or pneumatic energy into translational, mechanical energy or into rotatory mechanical energy.

A drive unit, which converts electric, hydraulic and/or pneumatic energy into translational, mechanical energy, is also designated as a linear drive.

A drive unit, which converts electric, hydraulic and/or pneumatic energy into rotational, mechanical energy, is also designated as a motor.

The drive unit can preferably be arranged in and/or on a guide element of the passage barrier.

A drive unit can preferably comprise at least one first torque transmission element, with the first torque transmission element transmitting torques from the drive unit to a guide element of the passage barrier.

In a particularly preferred further development of the disclosure, the drive unit can comprise a second torque transmission element, with the second torque transmission element transmitting torques from the drive unit to the hollow shaft.

In order to keep the complexity and number of variants of components in a rotary barrier low and to ensure a cost-effective manufacture, it is quite particularly preferred for the first torque transmission element and the second torque transmission element to be formed geometrically similar, in particular identically.

The first torque transmission element is arranged on the drive unit. The first torque transmission element can in particular be arranged in a frictional and/or positive and/or materially-bonded manner on the drive unit. The torque transmission element is preferably arranged on the drive unit so as to be detachable.

The second torque transmission element is also arranged on the drive unit. It is also advantageous to arrange the second torque transmission element in a frictional and/or positive manner on the drive unit so as to be detachable. The detachable arrangement can in particular be brought about by attaching, latching, engaging or similar. The advantage of a detachable arrangement of a torque transmission element on the drive unit is the simple assembly and, if necessary, the simple change since a torque transmission element may be exposed to high torques and movement cycles and exhibit signs of wear as a result.

It is also advantageous when the first torque transmission element is arranged in a frictional and/or positive manner with respect to the guide element so as to be detachable. In this connection, it is of course also advantageous when the second torque transmission element is arranged in a frictional and/or positive manner in the hollow shaft so as to be detachable. Through the detachable arrangement of a torque transmission element, a simple assembly in and, if necessary, a simple change of the torque transmission element from the hollow shaft or the guide element or a bearing element can take place.

In a further preferred configuration of the disclosure, the first torque transmission element is formed in a disc shape. It is further preferred for the second torque transmission element to also be formed in a disc shape. Disc shape is also understood in the sense of this application as annular configurations. The outer contour of a disc-shaped torque transmission element can adopt any desired contour, in particular however, round, elliptical, square or rectangular base shapes. In particular, the outer contour can also be formed in the shape of a toothing.

According to a first configuration of the disclosure, the torque transmission element is formed as a hub. In a particularly preferred embodiment, the hub is formed from a material having plastic deformation, in particular metal, preferably steel or aluminum or plastic.

The hub can advantageously have a hub covering, with the hub covering at least on the contact surfaces to the hollow shaft comprising a material having an elastic deformation, in particular rubber or India rubber. In an advantageous further development of the disclosure, the hub covering at least on its front end can include a material having an elastic deformation, in particular rubber or India rubber.

Through a preferred configuration of a torque transmission element as the hub with a hub covering, with the hub and the hub covering being formed from different materials, namely the hub covering of an elastic material and the hub of a non-elastic material, a particularly good smooth running and low vibration of the drive of a passage barrier can be implemented with simultaneous transmission of large torques. Torque peaks can also be easily absorbed by an elastic hub covering and, consequently, mechanical damage to the passage barrier can be prevented or at least reduced.

In order to ensure particularly good transmission of high torques, the hub can have a triangular base contour. The corners of the triangular base contour of the hub are particularly preferably replaced with concave, in particular circular-arc-shaped grooves. In this way, a particularly good fixing of the hub covering on the hub and a further increase in the torque transmission is in particular achieved.

To bring about an improved fixing of the hub covering on the hub, the hub can preferably have a plurality of openings, through which the hub covering engages.

The hub covering can in particular be manufactured in an injection-molding process.

The hollow shaft can, on the inside, comprise at least one first group of torque reception webs and the first torque transmission element can have at least one first group of torque transmission grooves, with the first group of torque reception webs engaging in a positive and/or frictional manner into the first group of torque transmission grooves.

It is particularly preferred when the hollow shaft comprises, on the inside, a second group of torque reception webs and the first torque transmission element has a second group of torque transmission grooves, with the second group of torque reception webs engaging in a positive and/or frictional manner into the second group of torque transmission grooves.

The first and the second group of torque transmission grooves and/or torque reception webs can differ in regard to their geometric and/or material properties.

It is in particular advantageous here for the first group of torque reception webs and the second group of torque reception webs to differ geometrically and the first group of torque transmission grooves and the second group of torque transmission grooves to differ geometrically.

According to a further development of the subject matter according to the disclosure, the first group of torque reception webs and the second group of torque reception webs can be arranged along the inner circumference of the hollow shaft in an alternating manner and the first group of torque transmission grooves and the second group of torque transmission grooves can be arranged along the outer circumference of the torque transmission element in an alternating manner.

In a quite particularly preferred configuration, the first group of torque reception webs and the second group of torque reception webs can be arranged along the inner circumference of the hollow shaft opposite one another and the first group of torque transmission grooves and the second group of torque transmission grooves can be arranged along the outer circumference of the torque transmission element opposite one another.

By forming at least two groups of torque reception webs and corresponding torque transmission grooves, an exact positioning of a torque transmission element in the hollow shaft can, on the one hand, be brought about and, on the other hand, it is possible to impart to both groups in each case different functions and/or properties in relation to positionability and/or torque transmission.

Thus, it is conceivable in a particularly preferred configuration of the disclosure that a first group of torque transmission grooves has a circular-arc-shaped contour, while a second group of torque transmission grooves has a rectangular contour. It is preferred here that the opening width of the circular-arc-shaped groove contour is larger than the opening width of the rectangular groove contour. It is quite particularly preferred when the opening width of the circular-arc-shaped groove contour is 4 to 10 times, in particular preferably 5 to 8 times larger than the opening width of the rectangular groove contour.

Using a configuration of this type, it is, on the one hand, possible that a sufficient torque transmission and smooth running during normal operation of the passage barrier is brought about and, on the other hand, in the event of a torque peak, as can for example be caused by vandalism (occurring in front of the barrier element), to safely absorb said torque peak and reduce the risk that the drive suffers mechanical damage.

The passage barrier has a drive, with the drive having a drive unit and an output unit. The drive unit, the output unit and the barrier element are operatively connected in such manner that the barrier element is movable via the output unit, which is operatively connected to the drive unit, into a position closing the gate region and into a position releasing the gate region.

The output unit can in turn be connected to a force transmission element in such manner that mechanical movement energy can be transmitted from the output unit to the force transmission unit. The force transmission element serves here in particular to move barrier elements.

The output unit can comprise other mechanical components, such as for example bearing, gear arrangements, deflection rollers, etc.

According to a particularly preferred embodiment of the disclosure, the output unit can comprise a hollow shaft. The hollow shaft has an outer shell surface and an inner shell surface, with the inner shell surface and the drive unit being configured in such manner that the inner shell surface surrounds the drive unit at least in sections, preferably completely. In this way, an improved acoustic encapsulation of the drive unit is brought about, whereby a smooth and quiet operation of the drive of the passage barrier can be implemented.

Moreover, the hollow shaft can have a barrier element mount, with the barrier element mount being formed to fix a barrier element on the hollow shaft. The barrier element mount is preferably arranged on the outer shell surface of the hollow shaft and formed integrally with the hollow shaft. In this way, a very cost-effective barrier element mount can be implemented since the barrier element mount is formed integrally in or on the hollow shaft.

The hollow shaft can be formed of a metal material, particularly preferably aluminum. However, it is also conceivable that the hollow shaft is formed of a plastic, in particular a fiber-reinforced plastic.

It is particularly preferred to form the hollow shaft as an extrusion or cast part. In particular, forming the hollow shaft as an extrusion has the advantage that barrier element mounts of any length can be manufactured in practice by the corresponding extrusion profile being easily separated to the desired length.

Moreover, it is preferred that the drive unit has a drive axis which coincides with the axis of rotation of the hollow shaft. In this way, a particularly simple mode of operation of a drive can be implemented.

According to another, advantageous configuration of the disclosure, the hollow shaft is mounted so as to be rotatable with respect to the guide element. Essentially, it is, however, also conceivable that the hollow shaft is mounted so as to be rotatable with respect to a wall, in particular a building wall.

It is also conceivable that the drive comprises a plurality of drive units. The plurality of drive units can preferably be surrounded by the inner shell surface of the hollow shaft at least partially, preferably completely. By arranging a plurality of drive units, a flexible and safe mode of operation of the passage barrier can be achieved, for example in the case of failure of one drive unit or by adding a drive unit in the case of required, larger drive power at the barrier element in order to be able to achieve for example a safe closure even against a physical resistance.

The hollow shaft can be fixed by means of one or a plurality of bearing elements on a guide element or a building wall in such manner that a mounted rotation of the hollow shaft with respect to a guide element or a building wall is made possible.

In a preferred design of the disclosure, at least one bearing element is arranged on a distal end of the hollow shaft. It is particularly preferred that in each case one bearing element is arranged in each case on a distal end of the hollow shaft.

The fixing of the bearing elements on a guide element can in particular be configured in such manner that they can be fixed on or in a guide element so as to be detachable.

According to a particularly preferred embodiment of the disclosure, the inner shell surface of the hollow shaft has a torque reception element. In this way, a torque can be transmitted directly from a drive unit to the hollow shaft. A torque reception element can in particular be formed for a frictional and/or positive torque transmission.

In order to form a frictional torque transmission, provision can be made according to a preferred configuration of the disclosure for the inner shell surface of the hollow shaft to have a top surface roughness value of R 0.15 to R 1.0.

According to another preferred embodiment of the disclosure, the torque transmission element of the hollow shaft comprises a torque reception toothing to form a positive torque transmission. Through the torque reception toothing, a very safe transmission even of larger torques to the hollow shaft is also made possible.

It can be provided that the torque reception toothing is formed integrally with the inner shell surface of the hollow shaft. In this connection, it is particularly preferred that the hollow shaft, as already described above, is formed as an extrusion or cast part. Through the integral formation of the torque reception toothing with the inner shell surface of the hollow shaft, a particularly simple and cost-effectively manufacturable type of torque transmission is implemented.

In another advantageous configuration of the disclosure, it is provided that the barrier element mount is formed substantially in a U-shape, with the barrier element being fixable between the limbs of the U-shaped barrier element mount, whereby a safer hold of an in particular plate-shaped barrier element can be implemented in the barrier element mount.

The barrier element mount can in particular be formed to fix a plate-shaped barrier element on the hollow shaft.

In order to fix the barrier element in the barrier element mount in a materially-bonded manner, in a preferred configuration of the disclosure, at least two adhesive grooves to receive an adhesive can be provided on the inside at the base of the U-shaped barrier element mount and on both limbs of the U-shaped barrier element mount on the inside, at least two opposing adhesive grooves to receive an adhesive can be provided.

In order to produce a materially-bonded connection, in particular adhesive connection, between the barrier element and the barrier element mount, a method is preferred in which the following steps are included:

a) applying an adhesive into the adhesive grooves of the barrier element mount by means of a nozzle, which has nozzle openings in the number of adhesive grooves,
b) inserting the plate-shaped barrier element into the barrier element mount
c) hardening of the adhesive It is also preferred that a plurality of drive units comprises substantially the same drive units. The same electric motors would for example preferably be used here, whereby the complexity and number of variants of a passage barrier is reduced.

The passage barrier is configured in such manner that the passage barrier has guide elements, with the guide elements comprising a first guide element and a second guide element, with the first guide element and the second guide element cooperating in such manner that they define a gate region, through which a person passes from an entrance region into a passage region. The guide elements therefore represent a physical barrier to guide a flow of people from the entrance region, through the gate region into a passage region.

A guide element can be formed as a housing-type mount of mechanical, hydraulic and/or electrical components of the passage barrier. The guide element can partially or completely surround individual groups of or all components of the passage barrier. Furthermore, mechanical, hydraulic and/or electrical components of the passage barrier can be arranged on the guide element, without being partially or completely surrounded by it.

One or a plurality of electrical, electronic and/or mechanical component(s) required in order to operate a passage barrier can be mounted on and/or in the guide element, in particular selected from the group of drive units, gears, controllers, safety apparatuses, monitoring apparatuses, monitoring systems, pulse sensors, locking apparatuses, power supply, energy storage devices, force transmission elements, etc.

A guide element can have any spatial shape suited to mounting the components or determining the gate region of the passage barrier. A guide element can in particular be formed in a wall-like manner. Wall-like in the sense of this application designates a perpendicular part, whose extension in length and height is much greater than in depth.

The guide elements can in particular be arranged parallel to one another.

The gate region, which is defined by the guide elements, can have a substantially square, rectangular, parallelogram-like base surface. However, circular-arc-shaped, curved or circular-segment-like base surfaces are also conceivable.

Furthermore, it is preferred that the guide elements have substantially identical outer geometries. In this way, the complexity and number of variants for passage barriers' and corresponding systems, which are formed of a plurality of passage barriers, can be further reduced.

The guide elements can for example be formed of a profile structure, which is fully or at least partially covered by cover elements. The cover elements can for example be formed of glass, plastic or metal as well as of a combination of these materials. In the sense of this application, a guide element can also be formed as part of a building structure, for example as a building wall.

A guide element can have at least one profile attachment element for attaching at least one profile of a guide element to the base of a building structure.

According to a preferred configuration of the disclosure, the profile attachment element has a vertical profile mount for mounting a vertically running profile on the profile attachment element and a horizontal profile feedthrough for feeding a horizontally running profile through the profile attachment element. Sensors for detecting objects inside the gate region can be arranged on and/or in the horizontally running profile in an advantageous further development of the disclosure. Furthermore, the drive of the passage barrier can preferably be arranged on and/or in the vertically running profile.

Furthermore, means for mechanically fixing electrical components of the passage barrier can be provided on the profile attachment element. These means can for example be selected from the group of screw connections, latch connections, snap-latch connections, clamping connections, insert connections, etc.

The profile attachment element can be in particular a cast part, in particular a metallic die-cast part.

The profile attachment element can also have at least one cable feedthrough, through which in particular electrical lines of an electrical component are guided from outside of the profile attachment element into the profile attachment element.

According to an advantageous further development of the disclosure, the profile attachment element can have at least two opposing cable feedthroughs, which are separated from one another by a partition wall.

Lastly, it is preferred that the cable feedthroughs are positioned on the side surfaces of the profile attachment element facing the gate region in order to ensure a simple and safe electrical assembly on both sides of a guide element.

The passage barrier comprises at least one barrier element, with the barrier element being arranged inside the gate region, with the barrier element, the first guide element and the second guide element cooperating in such manner that a passage of a person from the entrance region into the passage region can be prevented and/or enabled.

The barrier element is a movable element, which is used to close and/or open an entry opening in the gate region of the passage barrier to prevent and/or enable the passage of a person.

A barrier element can in particular be formed as a door leaf, as a turnstile, barrier bar or the like.

The closing and/or opening of the entry opening of the passage barrier by the barrier element can take place by rotating, pivoting, sliding or any combination thereof.

The drive can advantageously have a locking apparatus. Using the locking apparatus, a movement of the barrier element is in particular mechanically and/or electrically and/or magnetically preventable.

In this case, it is particularly preferably provided that the locking apparatus is wirelessly connected to the controller of the passage barrier. The locking apparatus can also be connected via an insert connection to the controller, with no additional cables being required to connect controller and locking apparatus.

It is also particularly preferably provided that the locking apparatus prevents a movement of the drive unit in order to prevent a movement of a barrier element. Alternatively or additionally, it can be provided that the locking apparatus prevents a movement of the output. Lastly, it can alternatively or additionally be provided that the locking apparatus prevents a movement of a gear between drive unit and output.

Preventing the movement can in particular be implemented by a latching element which can be transferred from a locking position into a release position along a working direction.

The passage barrier can also have a stop disc, which comprises a toothing engagement, which is engaged with the torque transmission toothing of the locking apparatus. The stop disc has on its stop disc circumferential surface a stop lug which protrudes radially from the stop disc circumferential surface, and cooperates with a stop element arranged on the vertically running profile in such manner that a rotation of the stop disc is delimited by the stopping of the stop lug against the stop element.

The stop disc and the stop lug are particularly preferably formed monolithically. In this way, the stop disc can be particularly easily and cost-effectively manufactured.

The torque transmission toothing of the locking apparatus in particular has a plurality of teeth, in particular preferably 3 teeth which protrude from the locking apparatus parallel to the vertically running profile. It is also preferred that the plurality of teeth of the torque transmission toothing are arranged in a circle with regular, identical circle division. Furthermore, it is advantageous that the stop disc comprises a plurality of toothing engagements corresponding to the plurality of teeth of the torque transmission toothing which are arranged in a circle with a regular, identical circle division.

According to a preferred configuration, the stop lug of the stop disc is arranged opposite a toothing engagement.

Furthermore, it is preferred that the stop element is arranged in the vertically running profile so as to be displaceable. In this way, the locking apparatus and the stop disc as well as the stop element can be positioned in relation to one another in a very simple and ergonomic manner.

In a preferred further development of the disclosure, the stop element has an in particular semi-circular recess which is configured in such manner that it comprises the stop disc.

BRIEF DESCRIPTION OF THE DRAWINGS

Further measures that improve the disclosure will be outlined in greater detail below with the description of preferred exemplary embodiments of the disclosure on the basis of the figures. In this case, the features mentioned in the claims and in the description may each be essential to the disclosure individually by themselves or in any combination. In this case, it must be noted that the figures have only a descriptive character and are not intended to limit the disclosure in any way.

They show.

DETAILED DESCRIPTION OF THE DRAWINGS

Figure 1:
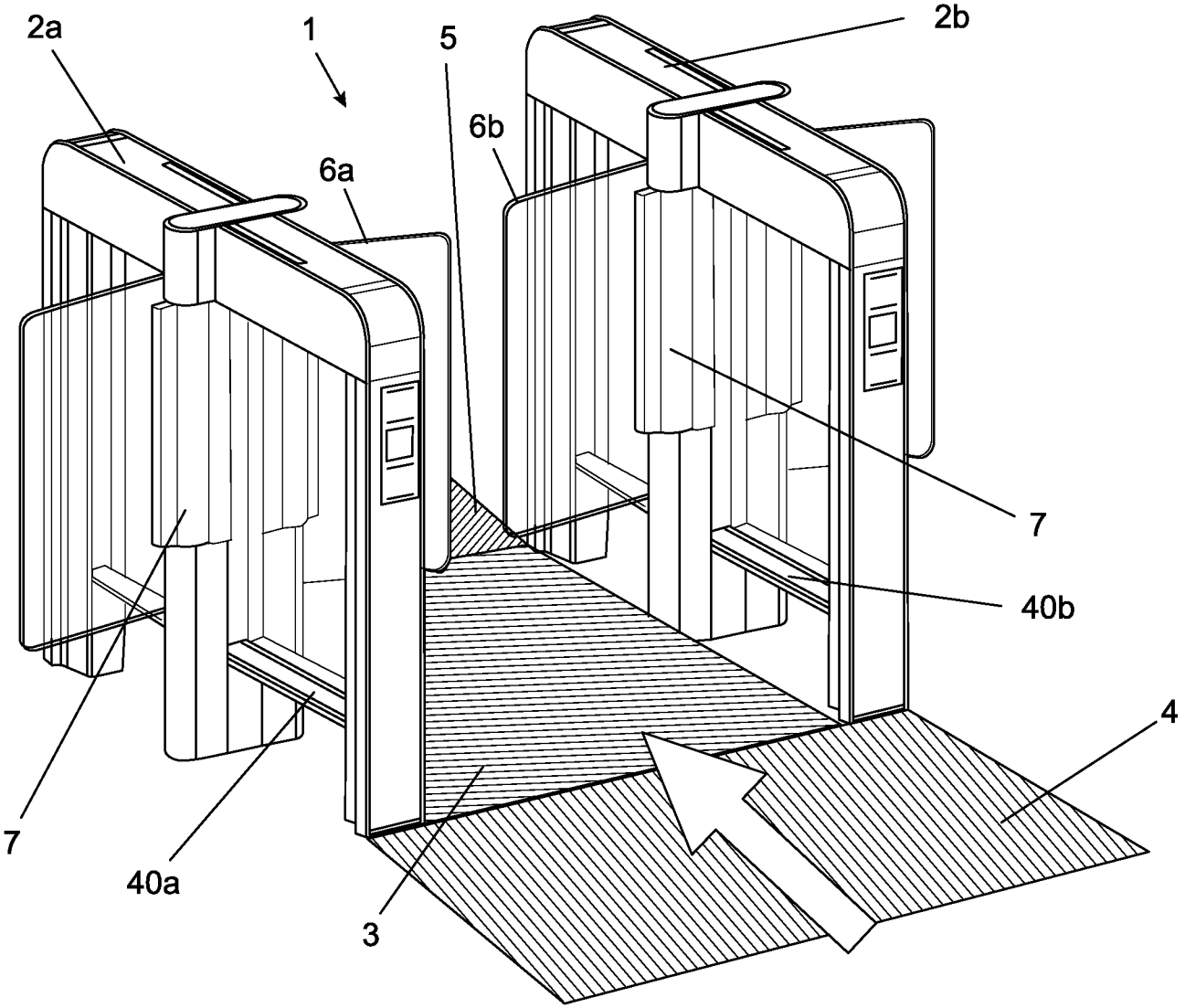
FIG. 1 passage barrier in perspective view

FIG. 1 shows a passage barrier 1, with the passage barrier 1 having guide elements 2*a*, 2*b*, with the guide elements 2*a*, 2*b* comprising a first guide element 2*a* and the guide elements 2*a*, 2*b* comprising a second guide element 2*b*, with the first guide element 2*a* and the second guide element 2*b* cooperating in such manner that they define a gate region 3, through which a person passes from an entrance region 4 into a passage region 5. The guide elements 2*a*, 2*b* are formed substantially in a wall-like manner and are arranged parallel to one another. As shown in FIG. 1, the guide elements 2*a*, 2*b* can be formed substantially identically in order to allow a modular-like structure of a passage barrier 1.

In the entry direction, symbolized in FIG. 1 by the arrow, the entrance region 4 is located in front of the guide elements 2*a*, 2*b*, through which a user of the passage barrier 1 accesses the gate region 3. When passing through the gate region 3 of the passage barrier 1, the user then enters into the passage region 5 in the entry direction behind the guide elements 2*a*, 2*b*.

The passage barrier 1 also comprises at least one barrier element 6*a*, 6*b*, with the barrier element 6*a*, 6*b* being arranged inside the gate region 3. The barrier element 6*a*, 6*b*, the first guide element 2*a* and the second guide element 2*b* cooperate in such manner that the passage of a person from the entrance region 4 into the passage region 5 can be prevented and/or enabled. In the represented exemplary embodiment, one barrier element 6*a*, 6*b* is in each case arranged on each of the guide elements 2*a*, 2*b*. The barrier elements 6*a*, 6*b* are formed in the shape of door leaves. In the represented exemplary embodiment, the barrier elements 6*a*, 6*b* are formed from a transparent material, such as for example glass or plastic.

The barrier elements 6*a*, 6*b* are arranged in a barrier element mount of the drive 7, as is explained in more detail in the following figures.

The passage barrier 1 also has a drive 7, with the drive 7 having a drive unit 8 and with the drive 7 having an output unit 9, with the drive unit 8, the output unit 9 and the barrier element 6*a*, 6*b* being operatively connected in such manner that the barrier element 6*a*, 6*b* is movable by means of the drive unit 8 into a position closing the gate region 3 and into a position releasing the gate region 3.

Figure 2:
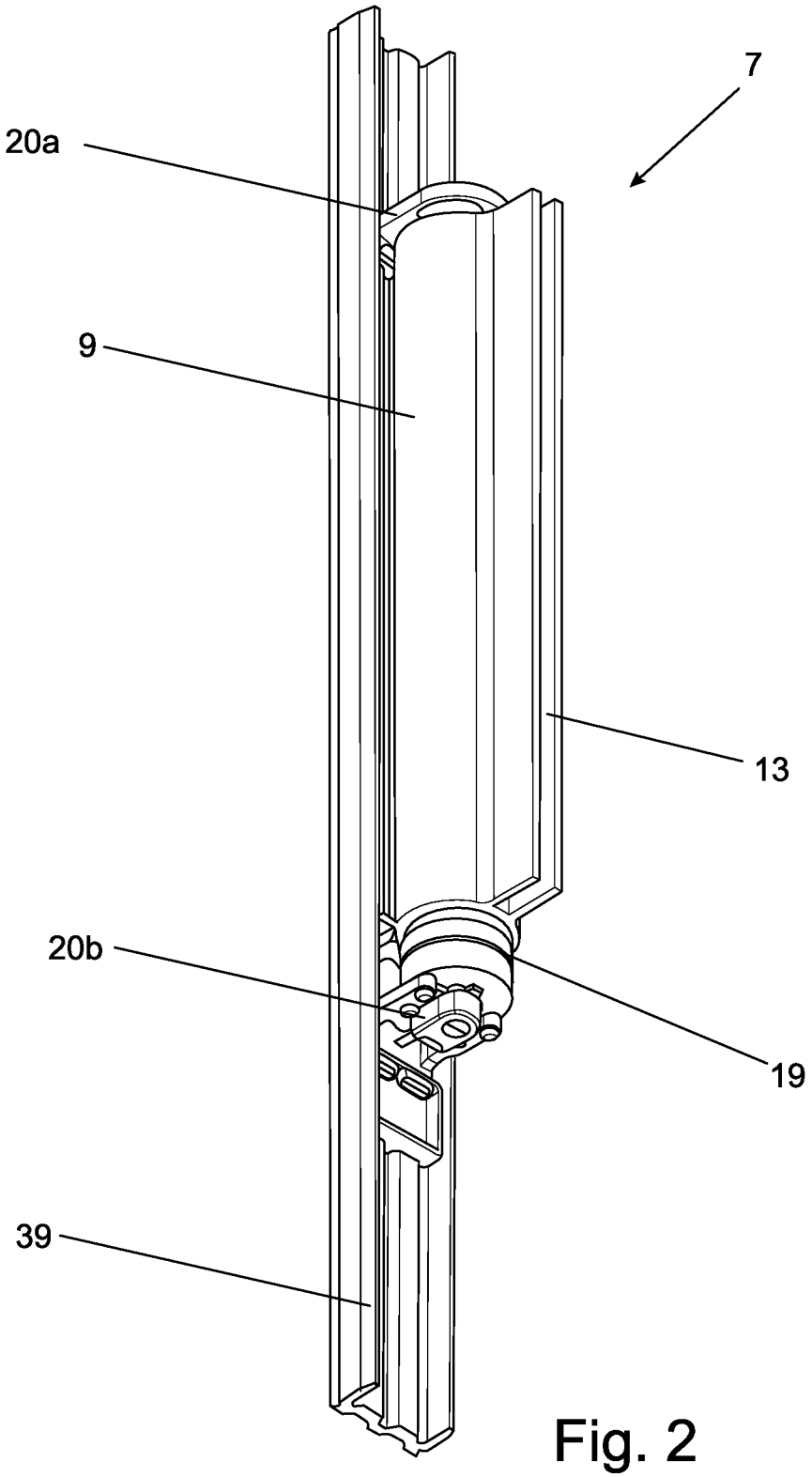
FIG. 2 drive in perspective view
Figure 3:
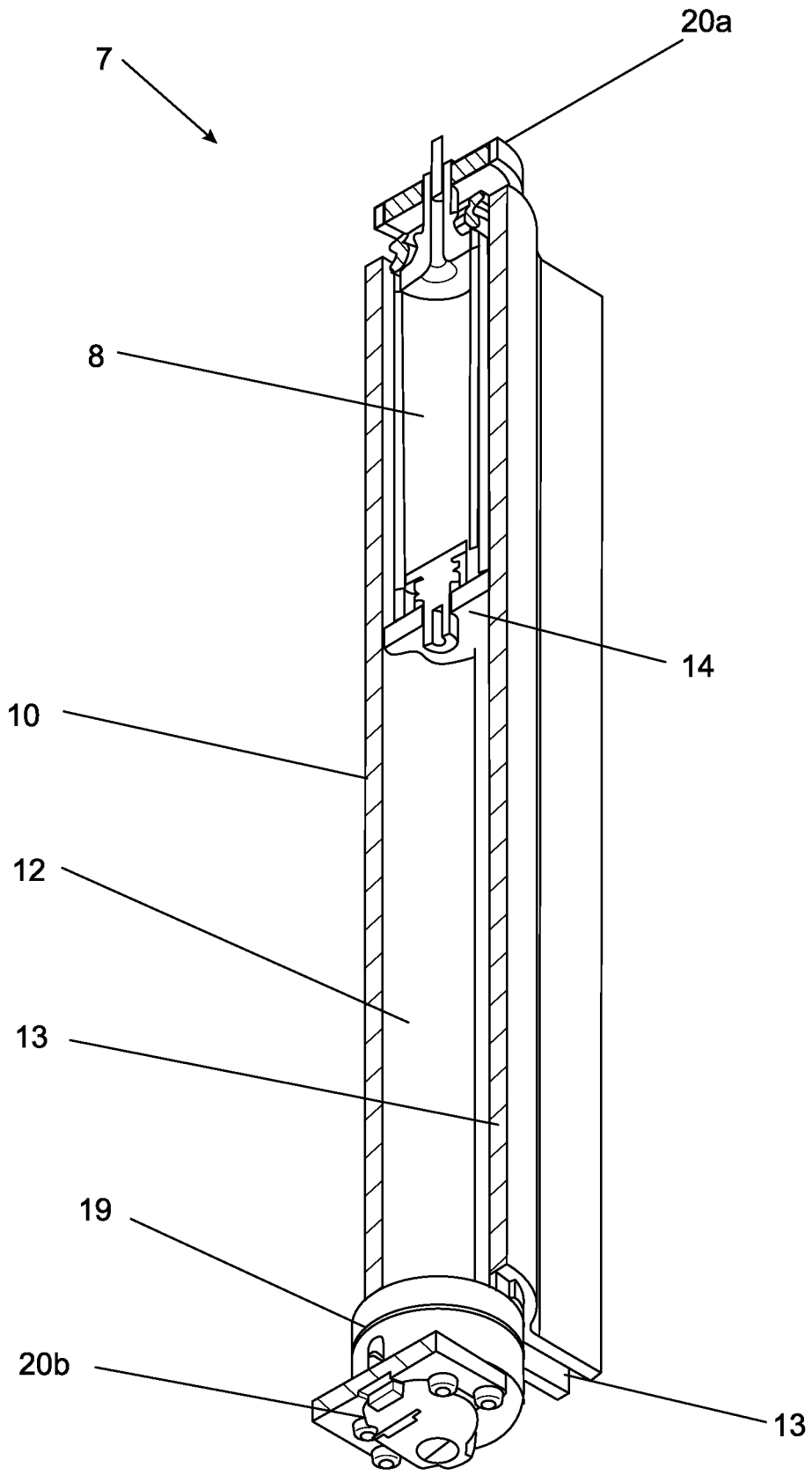
FIG. 3 drive in longitudinal section view

The drive 7 is explained in more detail on the basis of FIG. 2 and FIG. 3. The output unit 9 comprises a hollow shaft 10, with the hollow shaft 10 having an outer shell surface 11 and the hollow shaft 10 having an inner shell surface 12, with the inner shell surface 12 and the drive unit 8 being configured in such manner that the inner shell surface 12 surrounds the drive unit 8 at least in sections, preferably, as shown, completely.

The drive unit 8 is formed as an electric motor in the represented exemplary embodiment.

The hollow shaft 10 also has a barrier element mount 13, with the barrier element mount 13 being formed to fix a barrier element 6*a*, 6*b* on the hollow shaft 10. The barrier element mount 13 is arranged on the outer shell surface 11 of the hollow shaft 10 and formed integrally with the hollow shaft 10. To this end, the hollow shaft 10 is formed as an extrusion or cast part in the exemplary embodiment shown.

The barrier element mount 13 is formed substantially U-shaped, and the barrier element 6 (not shown) can be fixed between the limbs of the U-shaped barrier element mount 13.

The hollow shaft 10 is fixed by means of bearing elements 20*a*, 20*b* on the profile 39 in such manner that a rotation of the hollow shaft 10 with respect to a guide element 2*a*, 2*b* (not shown) is made possible. The bearing elements 20*a*, 20*b* are each arranged on a distal end of the hollow shaft 10. The fixing can in particular be configured in such manner that it is possible to displace the bearing elements 20*a*, 20*b* inside the profile 39. It is also advantageous to configure the bearing elements 20*a*, 20*b* in such manner that they can be fixed on or in the profile 39 so as to be detachable.

A locking apparatus 19 can be arranged on a distal end of the hollow shaft 10, as represented in FIG. 2, between the hollow shaft 10 and a bearing element 20*b* in order to prevent a movement of the hollow shaft 10 and consequently of the barrier element 6, in particular mechanically and/or electrically and/or magnetically and therefore to exclude any unauthorized opening and/or closing of the barrier element.

FIG. 3 shows a longitudinal sectioned view of the drive 7 known from FIG. 2. It can be seen that the drive unit 8 is formed as an electric motor and is arranged in the upper head region of the hollow shaft 10. The drive unit 8 is dimensioned in such manner that it can be pushed into the hollow shaft 10 along the inner shell surface 12 and is securely positioned in the hollow shaft 10. More detail will be provided on this later.

The positioning of the drive unit 8 along the axis of rotation of the hollow shaft 10 is defined by means of a torque transmission element 14 which can also be pushed into the hollow shaft 10. The torque transmission element 14 can be inserted in a frictional and/or positive manner into the hollow shaft 10 in order to implement a torque transmission from the drive unit 8 via the torque transmission element 14 to the hollow shaft 10.

Figure 4:
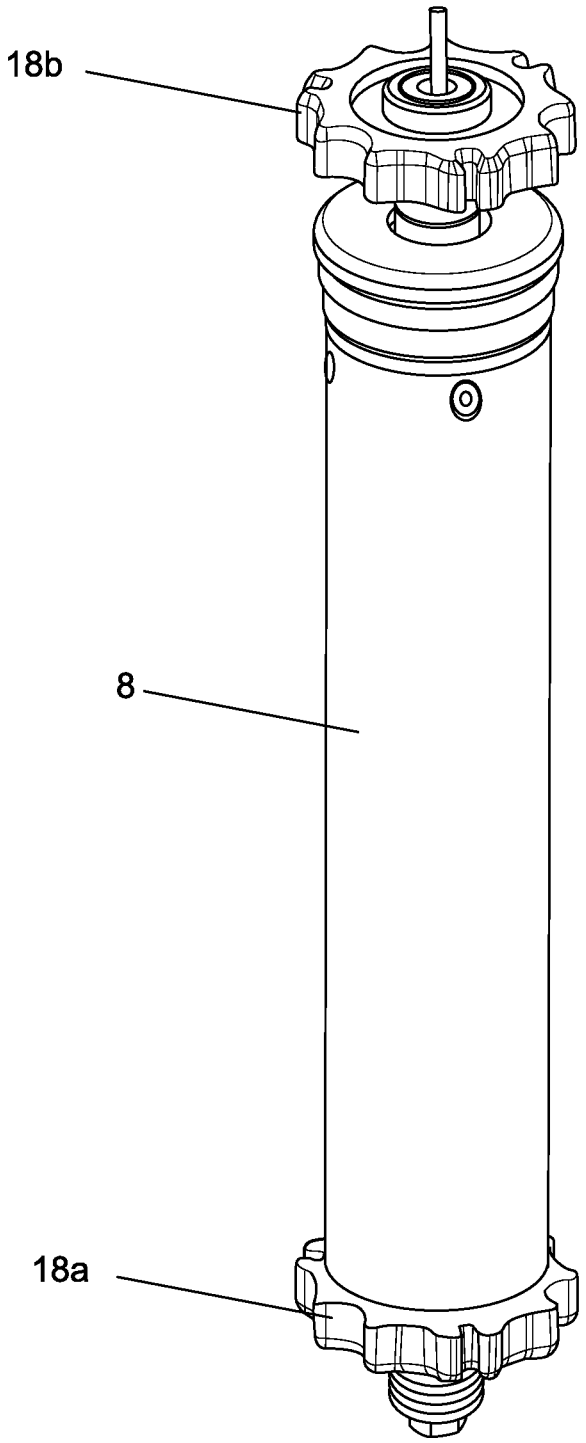
FIG. 4 drive unit in perspective view

It can also be inferred from FIG. 3 that the drive unit 8 has a drive axis which coincides with the axis of rotation of the hollow shaft 10. The configuration of the drive 7, as it is shown in FIGS. 2 to 3 in its arrangement inside the hollow shaft 10, is explained further on the basis of FIG. 4. It can be seen that the drive unit 7 is formed in a tubular shape and that torque transmission elements 18*a*, 18*b* are each arranged on the distal ends of the tubular drive unit 7. The torque transmission element 18*b* is connected to the output shaft of the drive unit 7, while the torque transmission element 18*a* is fixed on the housing of the drive unit 7 that is not rotating. It is preferred that the drive 7 is arranged in the hollow shaft 10 in this configuration.

Figure 5:
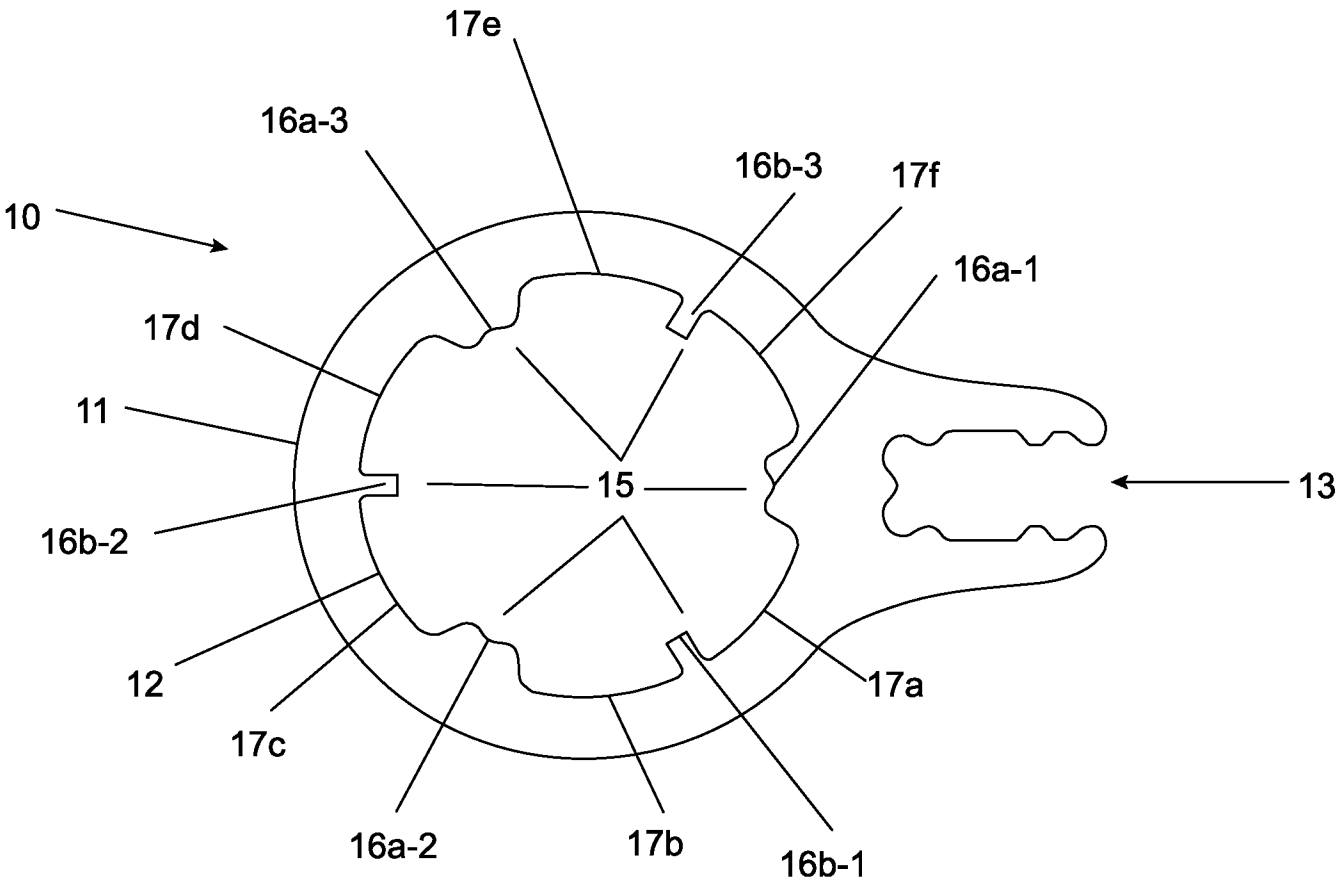
FIG. 5 output as a hollow shaft in top view

The hollow shaft 10 is described below in more detail on the basis of FIG. 5.

It can be seen that the inner shell surface 12 has a torque reception element which is formed as a torque reception toothing 15. The torque reception toothing 15 is formed integrally with the inner shell surface 12 of the hollow shaft 10. If the hollow shaft 10 has preferably been formed by means of an extrusion process, the torque reception toothing 15 of the hollow shaft 10 extends over its entire length of the inner shell surface 12.

It can also be seen that the torque reception toothing 15 is formed of torque reception webs 16*a*-1, 16*a*-2, 16*a*-3, 16*b*-1, 16*b*-2, 16*b*-3 and torque reception grooves 17*a*, 17*b*, 17*c*, 17*d*, 17*e*, 17*f* arranged between the torque reception webs 16*a*-1, 16*a*-2, 16*a*-3, 16*b*-1, 16*b*-2, 16*b*-3.

Figure 6:
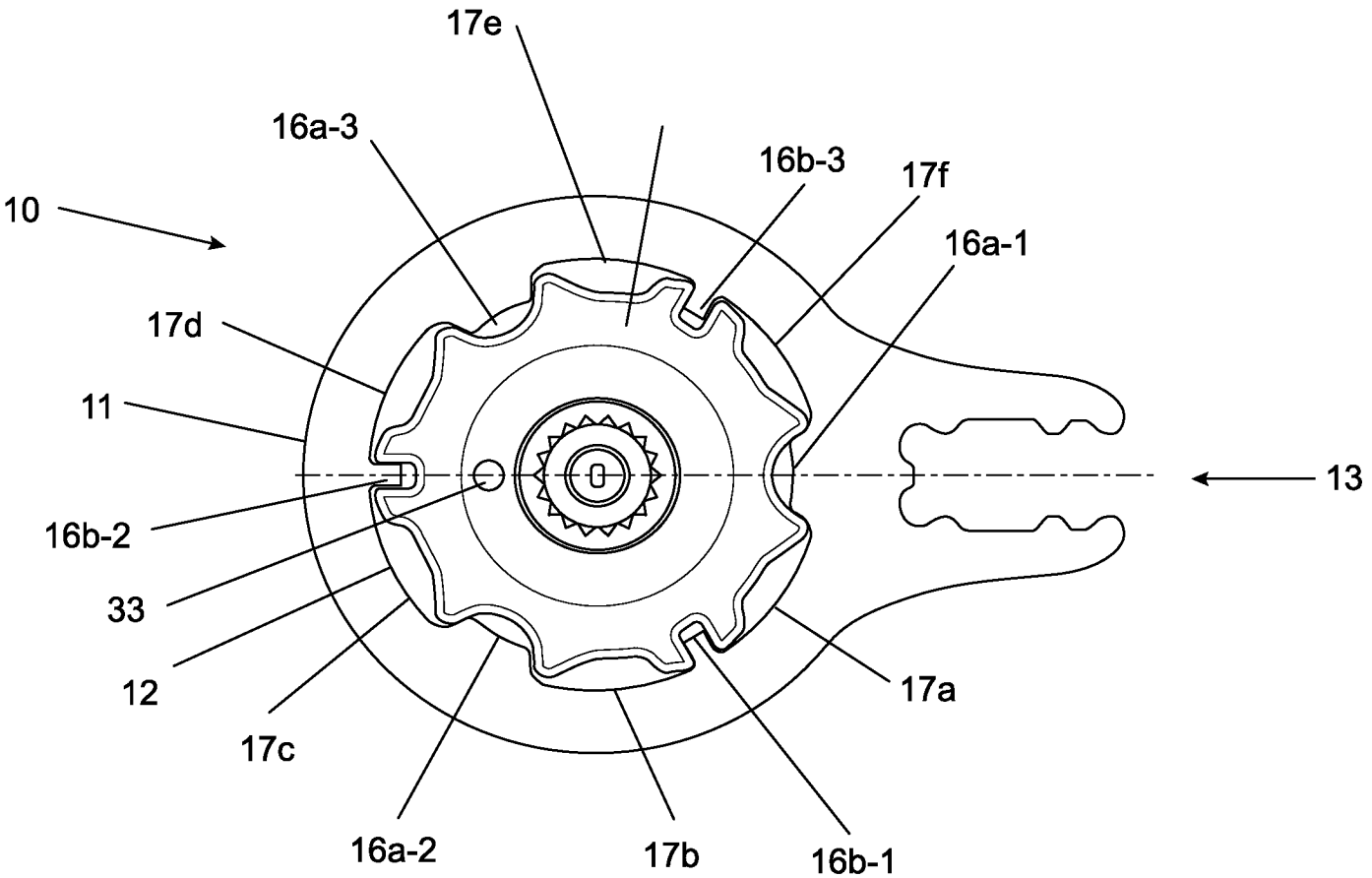
FIG. 6 hollow shaft with torque transmission element in top view

It is also discernible that the torque reception webs 16*a*-1, 16*a*-2, 16*a*-3, 16*b*-1, 16*b*-2, 16*b*-3 comprise a first group of torque reception webs 16*a*-1, 16*a*-2, 16*a*-3 and a second group of torque reception webs 16*b*-1, 16*b*-2, 16*b*-3, with the first group of torque reception webs 16*a*-1, 16*a*-2, 16*a*-3 being geometrically different from the second group of torque reception webs 16*b*-1, 16*b*-2, 16*b*-3. In the particularly preferred configuration shown, torque reception webs 16*a*-1, 16*a*-2, 16*a*-3 of the first group and torque reception webs 16*b*-1, 16*b*-2, 16*b*-3 of the second group are each opposite one another. A corresponding torque transmission element 18 (not shown) can be inserted into the hollow shaft 10 in exactly the correct position by means of this configuration. More detail will be given on this below on the basis of FIG. 6.

Figure 7:
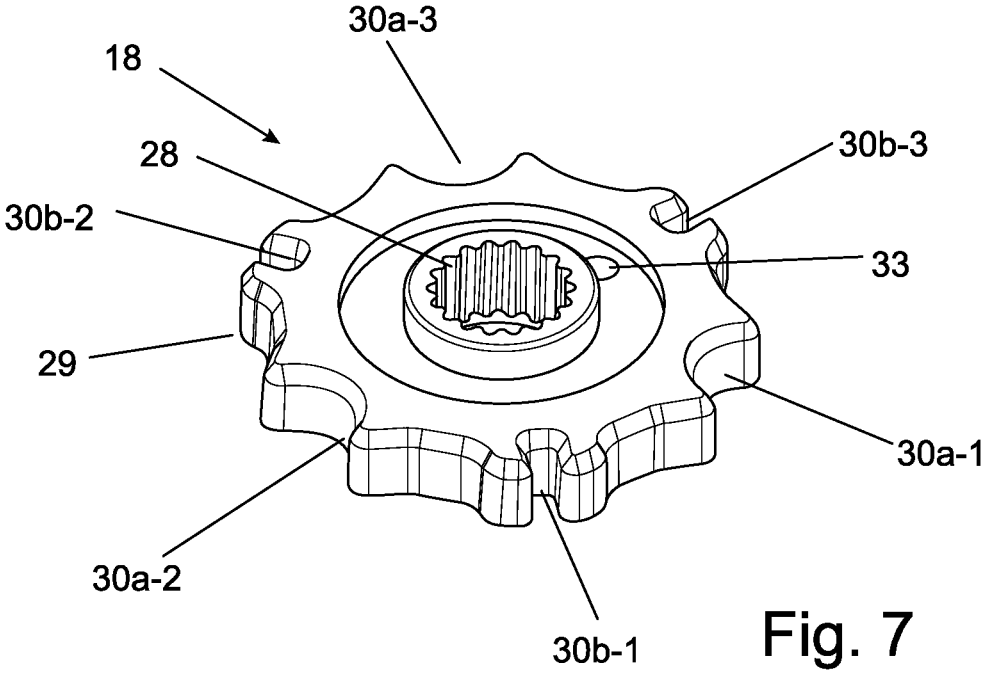
FIG. 7 torque transmission element in perspective view

FIG. 7 shows a torque transmission element 18 which is inserted into the torque reception toothing 15 of the hollow shaft 10. The torque transmission element 18 is formed as a hub, which has a hub inner toothing 28 and a hub outer toothing 29.

The hub outer toothing 29 comprises torque transmission grooves 30*a*-1, 30*a*-2, 30*a*-3, 30*b*-1, 30*b*-2, 30*b*-3, which are formed to be engaged with the corresponding torque reception webs 16*a*-1, 16*a*-2, 16*a*-3, 16*b*-1, 16*b*-2, 16*b*-3 in the inserted state of the hub toothing 29 in the hollow shaft 10.

It is also discernible that torque transmission grooves 30*a*-1, 30*a*-2, 30*a*-3, 30*b*-1, 30*b*-2, 30*b*-3 comprise a first group of torque transmission grooves 30*a*-1, 30*a*-2, 30*a*-3 and a second group of torque transmission grooves 30*b*-1, 30*b*-2, 30*b*-3, with the first group of torque transmission grooves 30*a*-1, 30*a*-2, 30*a*-3 being geometrically different from the second group of torque transmission grooves 30*b*-1, 30*b*-2, 30*b*-3. In the particularly preferred configuration shown, torque transmission grooves 30*a*-1, 30*a*-2, 30*a*-3 of the first group and torque transmission grooves 30*b*-1, 30*b*-2, 30*b*-3 of the second group are each opposite one another.

The torque transmission element 18 preferably also has a positioning aid 33 which visually indicates a positioning of the torque transmission element 18 with respect to the hollow shaft 10 and/or the barrier element mount 13. The positioning aid 33 can be formed as an opening, borehole, colored marking, engraving, web or similar. The positioning aid 33, as shown in FIG. 8, is particularly preferably arranged on a common axis with the torque reception groove 30*a*-3 and 30*b*-1 and the axis of rotation of the hub inner toothing 28.

Figure 8:
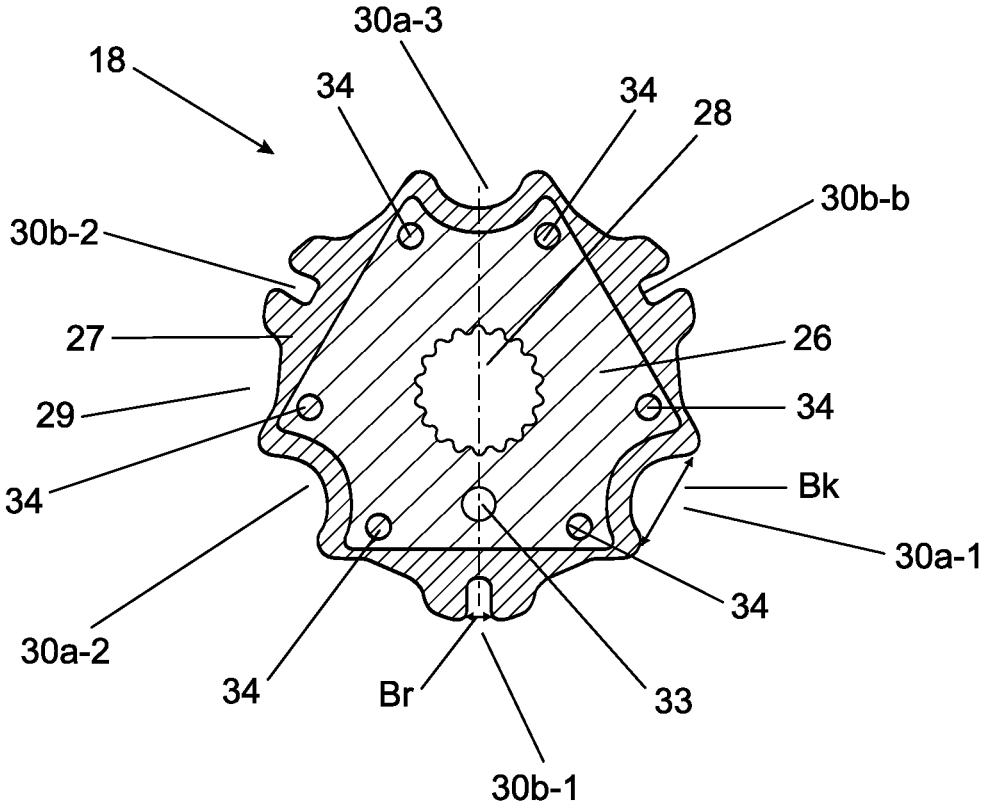
FIG. 8 hub and hub covering in sectioned view

In FIG. 8, a particularly preferred configuration of a torque transmission element 18 is depicted in a sectioned representation. The torque transmission element 18 comprises a hub 26 and a hub covering 27 here. The hub 26 and the hub covering 27 are formed here of different materials, which is indicated by the hatchings in FIG. 8. The hub covering 27 is preferably formed of an elastic material and the hub of a non-elastic material. The hub covering 27 is formed of a rubber-like material, in particular India rubber, with natural India rubber particularly preferably being used. Moreover, the hub is preferably formed of a metallic material, in particular of steel.

The hub 26 has a triangular base contour, with the corners of the triangular base contour being replaced for concave circular-arc-shaped grooves. In this way, a particularly good fixing of the hub covering 27 and the hub 26 is in particular achieved.

The hub also preferably has openings 34*a-f,* through which the hub covering 27 engages in order to thus bring about an improved fixing of the hub covering 27 and of the hub 26.

The hub outer toothing 28 is formed on the hub covering 27. As already explained in FIG. 7, the hub outer toothing 29 comprises torque transmission grooves 30*a*-1, 30*a*-2, 30*a*-3, 30*b*-1, 30*b*-2, 30*b*-3, which are formed to be engaged with the corresponding torque reception webs 16*a*-1, 16*a*-2, 16*a*-3, 16*b*-1, 16*b*-2, 16*b*-3 in the inserted state of the hub toothing 29 in the hollow shaft 10.

As a result the hub outer toothing 28 is manufactured from an elastic material in the exemplary embodiment shown in FIG. 8, a torque transmission element 18 configured in this manner can particularly advantageous absorb torque peaks and vibrations and as a result ensure a particularly safe and low-noise operation of the drive 7. This configuration also offers the advantage of providing simple, but effective torque overload protection in order to prevent mechanical damage in particular to the torque reception toothing on the inner shell surface of the hollow shaft.

In addition to the elastic configuration of the covering of the torque transmission element 18, the special geometric formation of the torque transmission element 18 also improves the torque overload protection and the smooth running of the drive of the passage barrier 1. To this end, the torque transmission element 18 has a first group of torque transmission grooves 30*a*-1, 30*a*-2, 30*a*-3, which have a circular-arc-shaped contour and the second group of torque transmission grooves 30*b*-1, 30*b*-2, 30*b*-3 which have a rectangular contour. The opening width Bk of the circular-arc-shaped groove contour of the first group of torque transmission grooves 30*a*-1, 30*a*-2, 30*a*-3 is preferably greater than the opening width Br of the rectangular groove contour of the second group of torque transmission grooves 30*b*-1, 30*b*-2, 30*b*-3, with the opening width Bk of the circular-arc-shaped groove contour in particular being 4 to 10 times, in particular preferably 5 to 8 times greater than the opening width Br of the rectangular groove contour.

Figure 9:
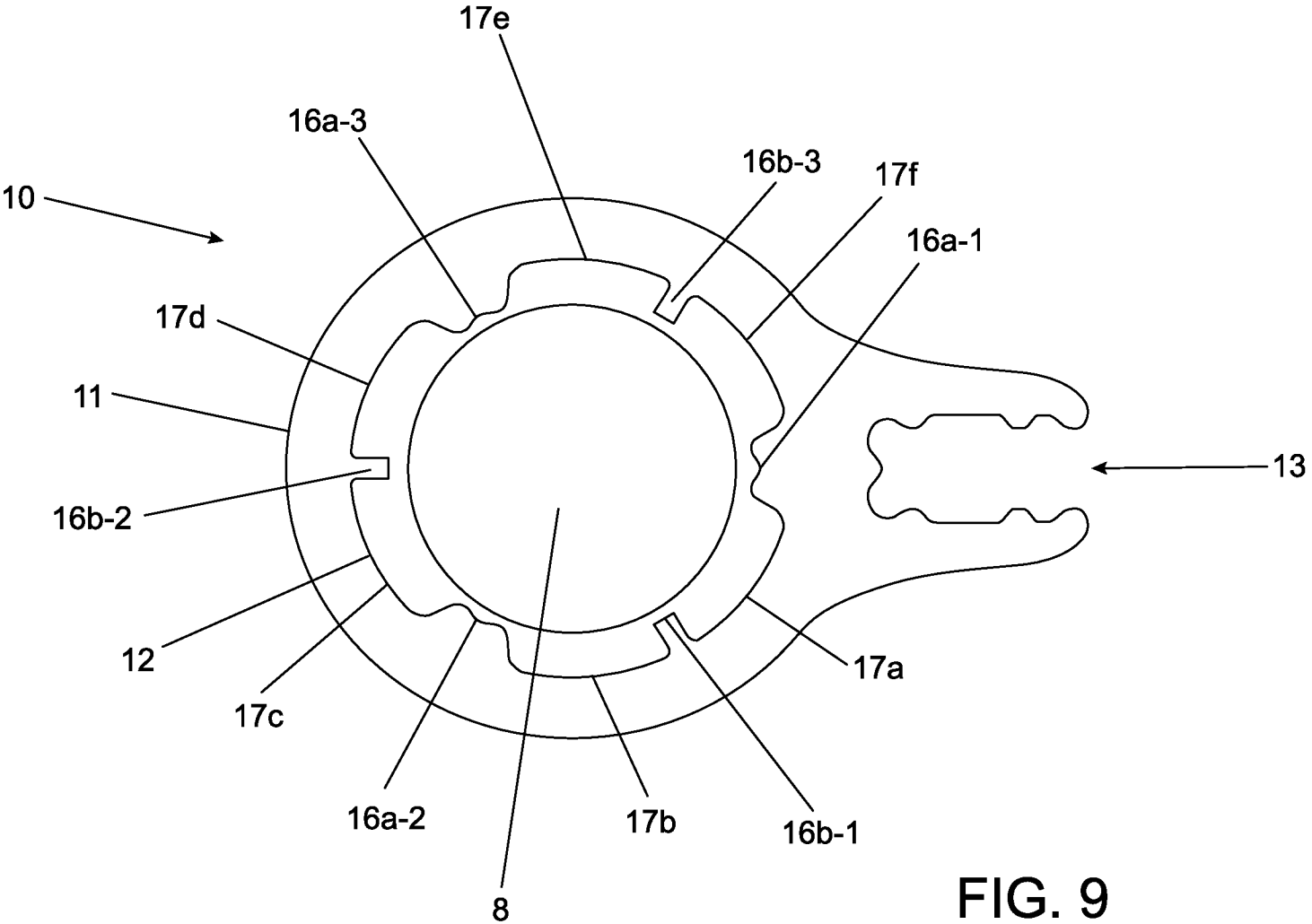
FIG. 9 arrangement of the drive unit in the hollow shaft in top view

FIG. 9 shows the arrangement of a drive unit 8 in the hollow shaft 10. It can be seen that the drive unit 8 in no way has direct contact points with the hollow shaft 10, whereby a transmission of vibrations and structure-borne noise from the drive unit 8 to the hollow shaft 10 is prevented and a low-noise operation of the passage barrier 1 is made possible. As a result, the mechanical and therefore also acoustic coupling preferably takes place via a hub 26, which is formed with an elastic hub covering 27, between the drive unit 8 and the hollow shaft 10, the smooth running of the passage barrier 1 can be further improved.

Figure 10:
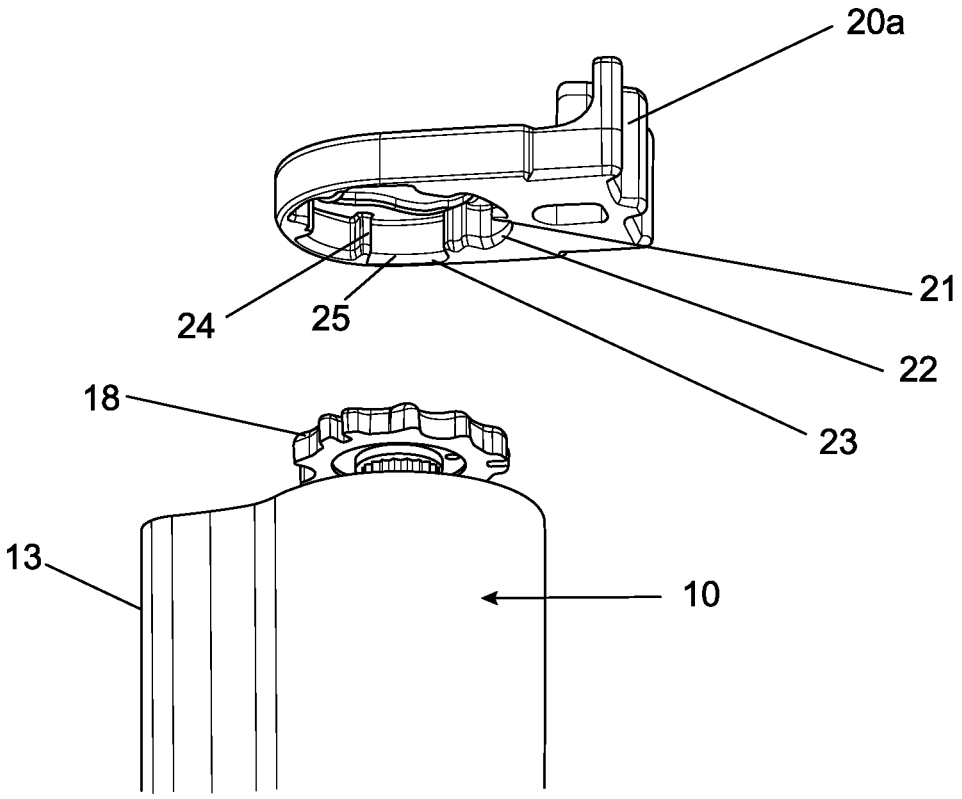
FIG. 10 drive unit, hollow shaft and bearing element in perspective view

FIG. 10 shows a bearing element 20*a* which is couplable with a torque transmission element 18 of the drive unit 8 which is arranged in the hollow shaft 10. To this end, the bearing element 20*a* has an opening with an inner shell surface 21. The inner shell surface 21 is configured in such manner that it is formed as a torque reception element 22 for torque-transmitting coupling with the torque transmission element 18. The torque reception element 22 of the bearing element 20*a* therefore comprises a torque reception toothing 23 which is configured to engage into a complementary torque transmission toothing 29 of the torque transmission element 18.

The torque reception toothing 23 of the bearing element 20*a* has a plurality of torque reception webs 24 and torque reception grooves 25 which are formed on the inner shell surface 21 of the bearing element 20*a*.

The dimensioning and geometric configuration of the torque reception webs 24 and torque reception grooves 25 of the bearing element 20*a* correspond substantially to the dimensioning and geometric configuration of the torque reception webs 16 and torque reception grooves 17 of the hollow shaft 10.

The bearing element 20*a* can be fixed, for example via a screw connection, on a guide element 2 of the passage barrier 1, so as to be detachable.

Figure 11:
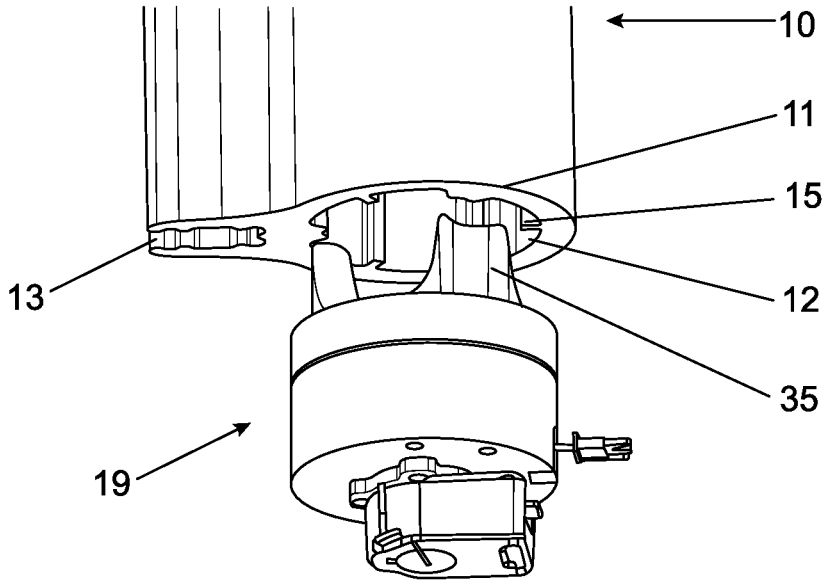
FIG. 11 locking apparatus and hollow shaft in perspective view

According to a further preferred configuration of the disclosure, a locking apparatus 19 can be provided on a distal end of the hollow shaft 10 which is shown in FIG. 11 and is described below.

The locking apparatus 19 is preferably formed as a toothed brake. The locking apparatus 19 has a torque transmission toothing 35, which is formed such that it can engage into the complementary torque reception toothing 15 of the hollow shaft 10. In this way, the locking apparatus 19 can be coupled with the hollow shaft 10 in a torque-transmitting manner by simply inserting it into the hollow shaft. The locking apparatus can be configured in particular as a toothed brake.

Figure 12:
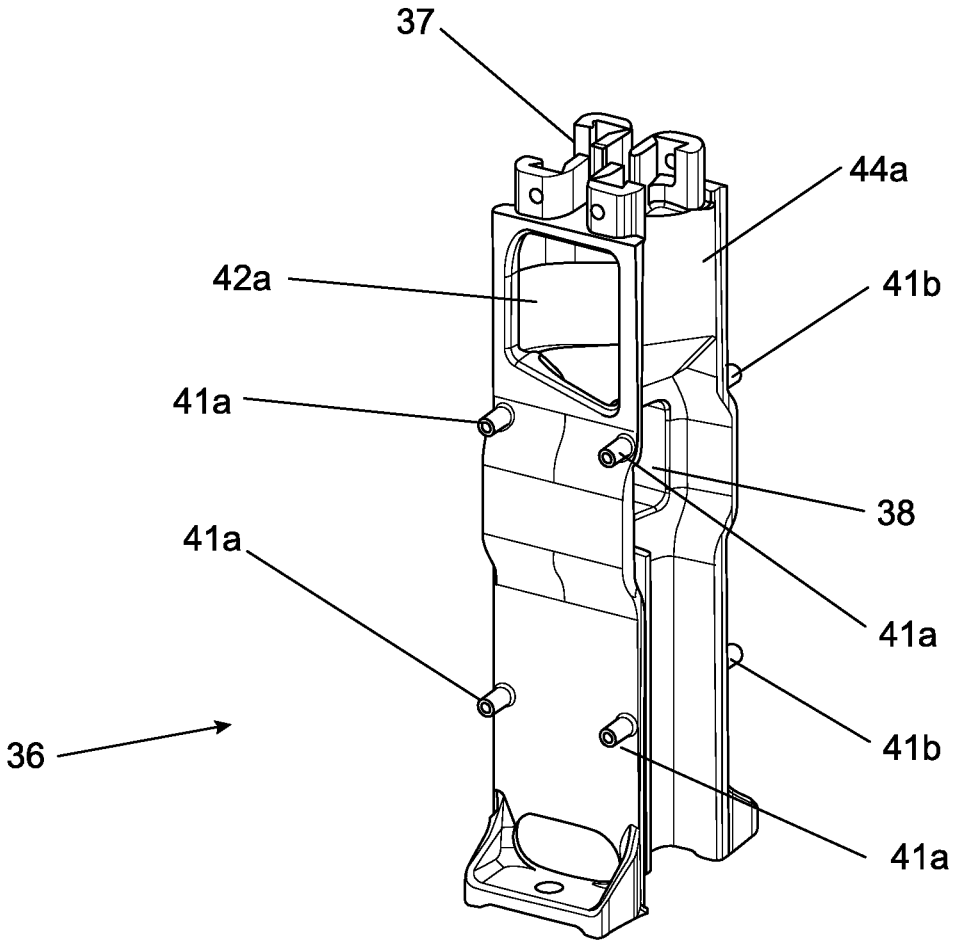
FIG. 12 profile attachment element in perspective view

FIG. 12 shows a profile attachment element 36 which is used in a guide element 2*a*, 2*b* in order to provide an attachment of at least one profile of a guide element 2*a*, 2*b* on the base of a building structure.

Figure 13:
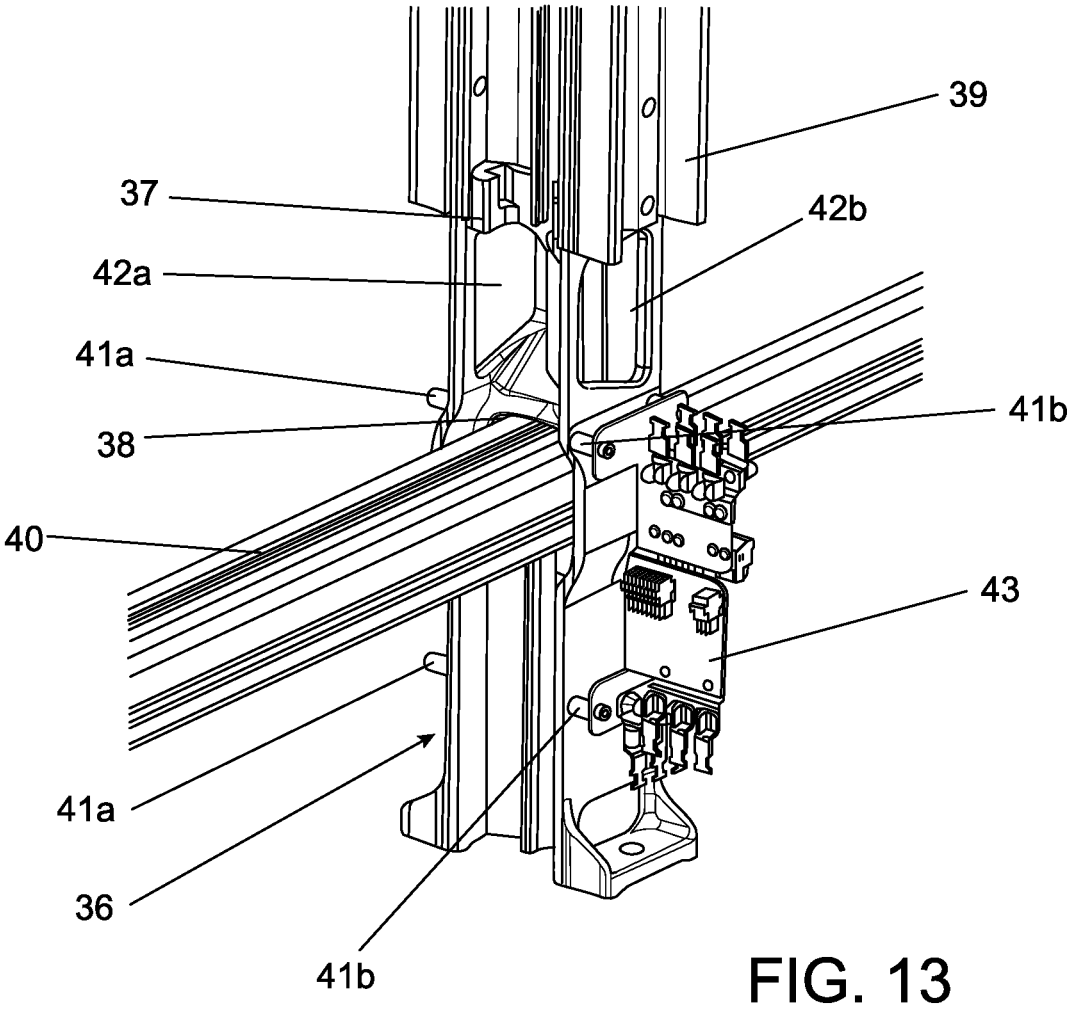
FIG. 13 profile attachment element with vertical and horizontal profiles

The profile attachment element 36 has a vertical profile mount 37 for mounting a vertically running profile 39 (represented in FIG. 13) on the profile attachment element 36.

The profile attachment element 36 also has a horizontal profile feedthrough 38 for feeding a horizontally running profile 40 (represented in FIG. 13) through the profile attachment element 36.

Moreover, means 41*a*, 41*b* are provided on the profile attachment element 36 to mechanically fix electrical components 43 (represented in FIG. 13) of the passage barrier 1.

The profile attachment element 36 has a substantially square spatial shape, with the longitudinal sides of the profile attachment element 36 extending in the vertical direction in the mounted state. The elements of the profile attachment element 36, which are arranged on the sides of the square profile attachment element 36 facing the gate region 3 of the passage barrier 1, are marked with the additional reference numeral a or b.

In particular, sensors (not represented) for detecting objects within the gate region 3 can also be arranged on and/or in the horizontally running profile 40, which runs through the horizontal profile feedthrough 38 of the profile attachment element 36.

Furthermore, the drive 7 of the passage barrier 1 can be arranged on and/or in the vertically running profile 39, it is for example shown in FIG. 2.

The profile attachment element 36 is formed as a cast part, in particular a metallic die-cast part.

Furthermore, the profile attachment element 36 has a first cable feedthrough 42*a* and a second cable feedthrough 42*b*, with the first cable feedthrough 42*a* and the second cable feedthrough 42*b* being located opposite one another and each being arranged on the sides of the profile attachment element 36 facing the gate region. Electrical lines of an electrical component 43 (represented in FIG. 13) are in particular guided through the cable feedthroughs 42*a*, 42*b* from outside of the profile attachment element 36 into the profile attachment element 36.

Figure 14:
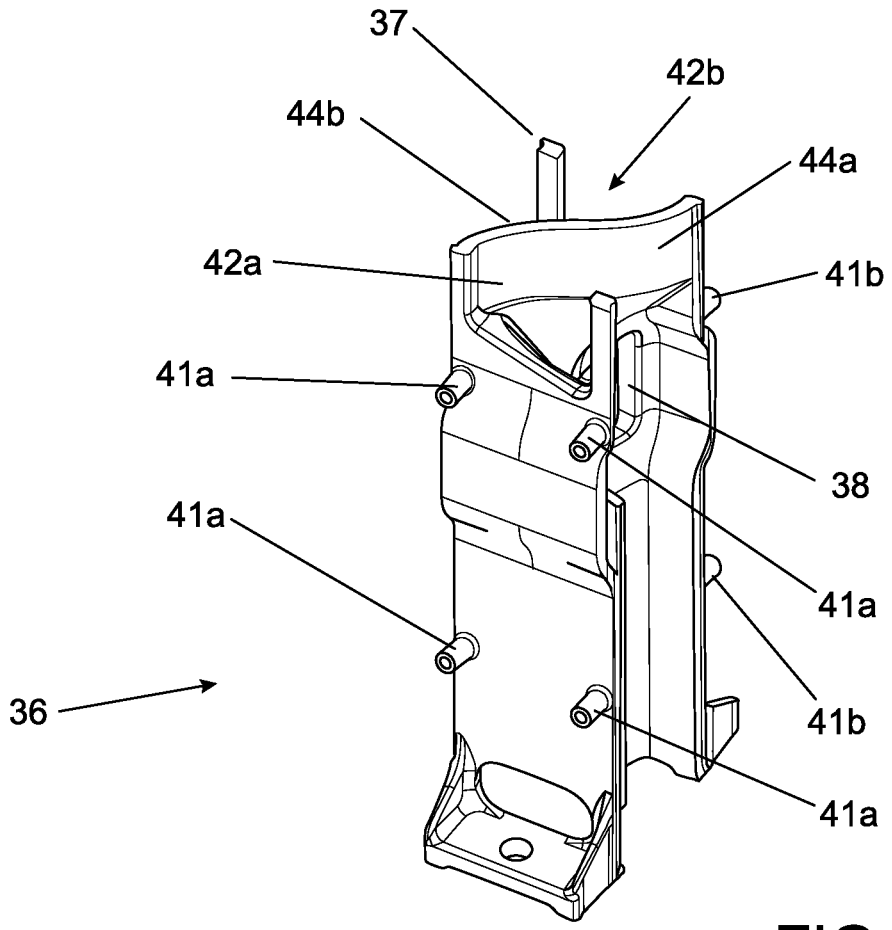
FIG. 14 profile attachment element in a sectioned representation

The opposing cable feedthroughs 42*a*, 42*b* are separated from one another by a partition wall 44, 44*a*, 44*b*. The partition wall 44, 44*a*, 44*b* runs substantially diagonally through the square profile attachment element 36 as is easily visible in FIG. 14. In this way, it can be ensured that cables can be guided from an electrical component 43 only in a predetermined space of the profile attachment element 36 or of a guide element 2*a*, 2*b*, whereby the risk of possible incorrect wiring of electrical components 43 in the passage barrier 1 can be minimized.

Figure 15:
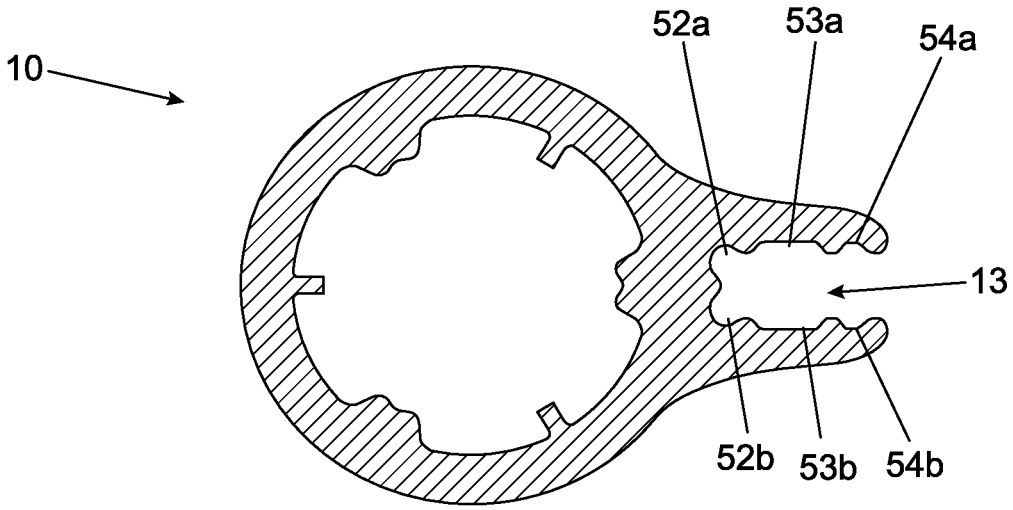
FIG. 15 barrier element mount in cross-sectional view

FIG. 15 shows the hollow shaft 10 with a barrier element mount 13, with the barrier element mount 13 being formed for fixing a plate-shaped barrier element 6*a*, 6*b* (not shown) on the hollow shaft (10). The barrier element mount 13 is formed substantially U-shaped and the barrier element 6 is fixed between the limbs of the U-shaped barrier element mount 13, which is shown in greater detail in FIG. 17.

At least two adhesive grooves 52*a*, 52*b* are provided for receiving an adhesive 55 on the inside at the base of the U-shaped barrier element mount 13. Furthermore, at least two opposing adhesive grooves 53*a*, 53*b* are provided for receiving an adhesive 55 on the inside on both limbs of the U-shaped barrier element mount 13.

Furthermore, opposing grooves 54*a*, 54*b* are formed on the inside on the distal ends of the U-shaped barrier element mount 13.

Figure 16:
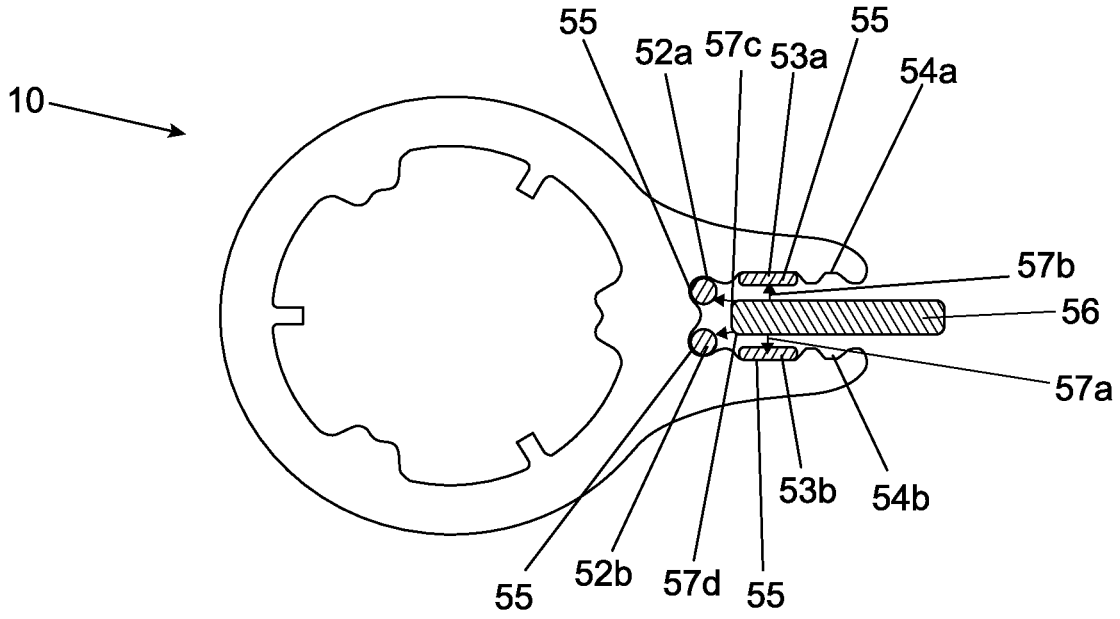
FIG. 16 production of an adhesive bond between barrier element and barrier element mount FIG. 17 barrier element mount with inserted barrier element FIG. 18 passage barrier with vertically running profile, locking apparatus, stop disc, hollow shaft in an exploded representation

A method for producing a materially-bonded connection between the barrier element mount 13 and a barrier element 6 is explained in more detail on the basis of FIG. 16. Firstly, a nozzle 56 is inserted into the barrier element mount 13 and then an adhesive is introduced into the adhesive grooves 52*a*, 52*b*, 53*a*, 53*b* of the barrier element mount 13 by means of a nozzle 56. The nozzle 56 has nozzle openings 57*a*, 57*b*, 57*c*, 57*d* corresponding with the number of adhesive grooves 52*a*, 52*b*, 53*a*, 53*b*, with the nozzle openings 57*a*, 57*b*, 57*c*, 57*d* being configured such that they apply the adhesive 55 into the corresponding adhesive grooves 52*a*, 52*b*, 53*a*, 53*b*.

Figure 17:
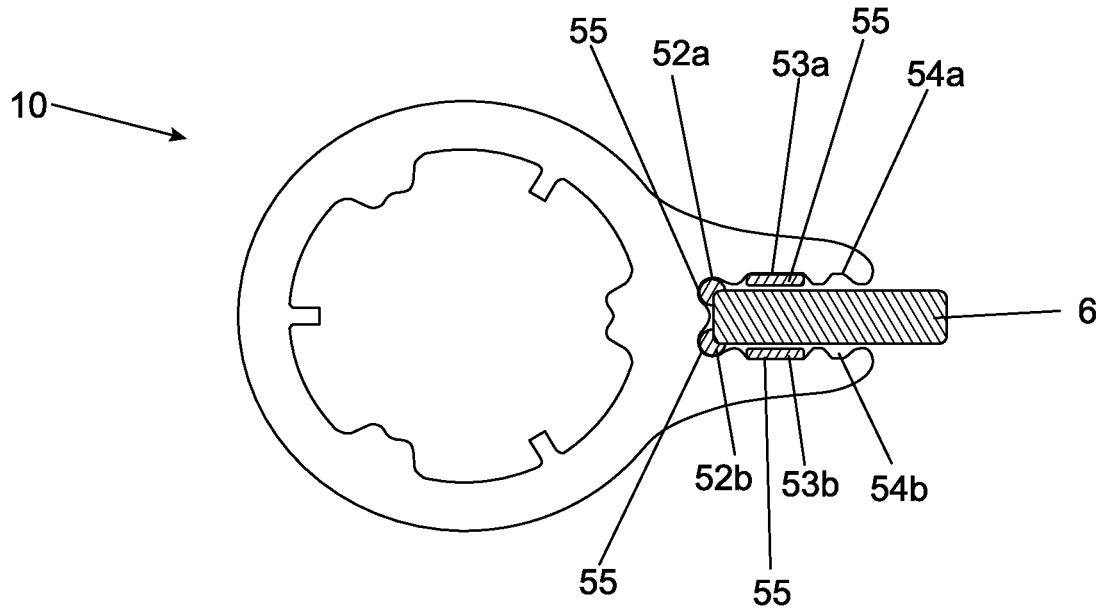

After removing the nozzle 56 from the barrier element mount 13, the plate-shaped barrier element 6 is inserted into the barrier element mount 13 and the adhesive 55 is hardened. This state is shown in FIG. 17.

Figure 18:
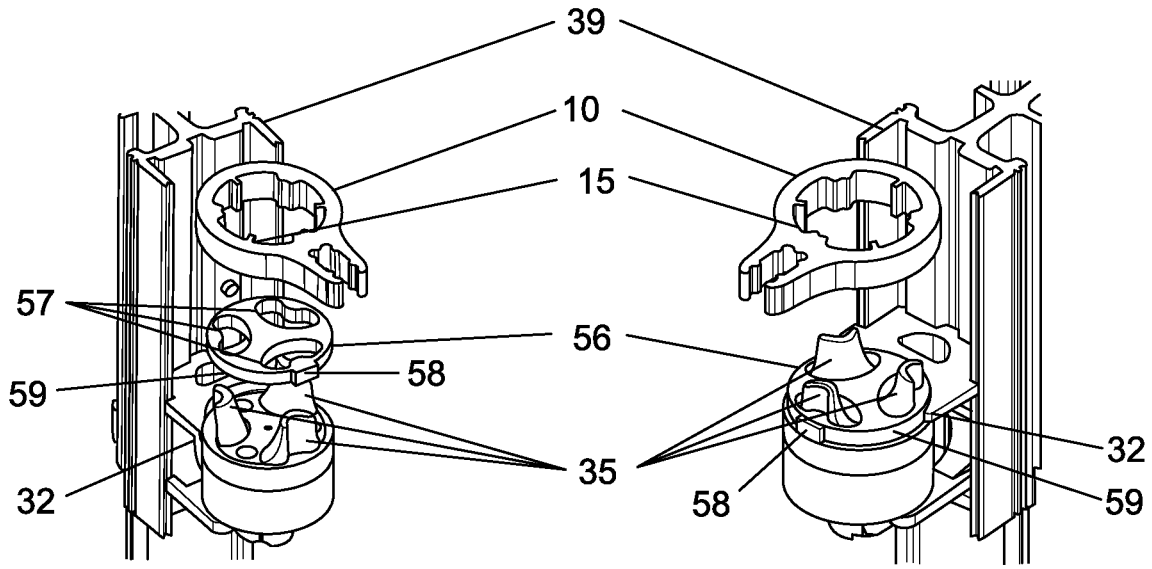

FIG. 18 shows the passage barrier according to the disclosure with vertically running profile 39, with a locking apparatus 19 arranged on the profile 39, a stop disc 56 couplable to the locking apparatus 19, a hollow shaft 10 couplable to the locking apparatus 19 in an exploded representation, with the right image showing the arrangement with stop element 32 arranged on the locking apparatus 19.

A locking apparatus 19 is arranged on the vertically running profile 3. The locking apparatus 19 has a torque transmission toothing 35, which engages into a complementary torque reception toothing 15 of the hollow shaft 10. A circular stop disc 56 is also present, which has a toothing engagement 57, which is engaged with the torque transmission toothing 35 of the locking apparatus 19.

The stop disc 56 has on its stop disc circumferential surface 59 a stop lug 58 which protrudes radially from the stop disc circumferential surface 59. The stop lug 58 cooperates with a stop element 32 arranged on the vertically running profile 39 in such manner that a rotation of the stop disc 56 is delimited by the stopping of the stop lug 58 against the stop element 32.

The stop disc 56 and the stop lug 58 are formed monolithically.

The torque transmission toothing 35 has three teeth in the embodiment shown which protrude from the locking apparatus 14 parallel to the vertically running profile 39. The plurality of teeth of the torque transmission toothing 35 is arranged in a circle with a regular, identical circle division.

It is easily discernible on the basis of FIG. 18 that the stop disc 56 comprises a plurality of toothing engagements 57 corresponding to the plurality of teeth of the torque transmission toothing 35 which are arranged in a circle with a regular identical circle division. The toothing engagements 57 are arranged as openings in the stop disc 56 through which the torque transmission toothing 35 engages.

In the exemplary embodiment shown, the stop lug 58 of the stop disc 56 is arranged opposite a toothing engagement 57. In this configuration shown, a barrier element arranged on the hollow shaft 10 can be rotated in two directions by 90° before the stop lug 58 abuts against the stop element 32 and the opening angle of the barrier element is thus mechanically delimited.

The stop element 32 is arranged in the vertically running profile 39 so as to be displaceable. It has a semi-circular recess which is configured in such manner that it comprises the stop disc 56.

When assembling the passage barrier, the following steps are then carried out in any order:

Arrangement of the locking apparatus 19 on the vertically running profile 39 of a guide element, Arrangement of the stop element 32 on the vertically running profile 39 of the guide element, Arrangement of a stop disc 56 on the locking apparatus 19 and subsequent arrangement of the hollow shaft 10 on the locking apparatus 19

The invention claimed is:

1. A passage barrier comprising:

a first guide element and a second guide element, wherein the first guide element and the second guide element cooperate to define a gate region therebetween, through which a person is configured to pass from an entrance region to a passage region;

at least one barrier element, wherein the barrier element is arranged inside the gate region, wherein the barrier element, the first guide element and the second guide element cooperate such that a passage of a-the person from the entrance region into the passage region is configured to be prevented or allowed; and a drive having a drive unit and an output unit, wherein the drive unit, the output unit, and the barrier element are operatively connected such that the barrier element is movable by the drive unit into a position wherein the barrier element prevents passage through the gate region and into a position wherein the barrier element allows passage through the gate region wherein wherein the output unit comprises a hollow shaft, wherein the hollow shaft has an outer shell surface and an inner shell surfae, wherein the inner shell surface and the drive unit are configured such that the inner shell surface surrounds the drive unit and the hollow shaft has a barrier element mount, wherein the barrier element mount fixes the barrier element on the hollow shaft, the barrier element mount is arranged on the outer shell surface of the hollow shaft and the barrier element mount is formed integrally with the hollow shaft, wherein the inner shell surface includes a torque reception element and the torque reception element comprises a torque reception toothing, wherein the drive unit comprises at least one torque transmission element configured to transmit torque from the drive unit to the barrier element, wherein the at least one torque transmission element has torque transmission toothing such that when the at least one torque transmission element is inserted into the torque reception toothing, the torque reception toothing engages with the torque transmission toothing to non-movably fix the drive unit to the hollow shaft.

2. The passage barrier, according to claim 1, wherein the torque reception toothing is formed integrally with the inner shell surface of the hollow shaft.

3. The passage barrier, according to claim 1, wherein the hollow shaft is formed as an extrusion or cast part.

4. The passage barrier, according to claim 1, wherein the barrier element mount is substantially U-shaped, wherein the barrier element is fixable between the limbs of the U-shaped barrier element mount.

5. The passage barrier, according to claim 1, wherein the hollow shaft is mounted to be rotatable with respect to at least one of the first and second guide elements.

6. The passage barrier, according to claim 1, wherein the drive unit has a drive axis which is coaxial with an axis of rotation of the hollow shaft.

7. The passage barrier, according to claim 1, wherein the torque reception toothing comprises a first group of torque reception toothing and a second group of torque reception toothing which are geometrically different from one another.

8. A method for manufacturing a passage barrier, wherein the passage barrier has a first guide element and a second guide element, wherein the first guide element and the second guide element cooperate to define a gate region therebetween, through which a person is configured to pass from an entrance region to a passage region, the passage barrier comprises at least one barrier element, wherein the barrier element is arranged inside the gate region, wherein the barrier element, the first guide element and the second guide element cooperate such that a passage of the person from the entrance region to the passage region can be prevented or allowed, the passage barrier has a drive, wherein the drive has a drive unit and has an output unit, wherein the drive unit, the output unit and the barrier element are operatively connected such that the barrier element is movable by the drive unit into a position wherein the barrier element prevents passage through the gate region and into a position wherein the barrier element allows passage through the gate region, wherein the output unit comprises a hollow shaft, wherein the hollow shaft has an outer shell surface and an inner shell surface, wherein the inner shell surface and the drive unit are configured such that the inner shell surface surrounds the drive unit and the hollow shaft has a barrier element mount, wherein the barrier element mount fixes the barrier element on the hollow shaft, the barrier element mount is arranged on the outer shell surface of the hollow shaft and the barrier element mount is formed integrally with the hollow shaft, wherein the inner shell surface includes a torque reception element and the torque reception element comprises a torque reception toothing, wherein the drive unit comprises at least one torque transmission element configured to transmit torque from the drive unit to the barrie element, wherein the at least one torque transmission element has torque transmission toothing such that when the at least one torque transmission element is inserted into the torque reception toothing, the torque reception toothing engages with the torque transmission toothing to non-movably fix the drive unit to the hollow shaft, the method including, in any order, the steps of:

inserting the drive unit into the hollow shaft, fixing the barrier element to the barrier element mount of the hollow shaft, and fixing the drive to at least one of the first and second guide elements.

* * * * *